US010654238B2

(12) United States Patent
Messerschmid et al.

(10) Patent No.: US 10,654,238 B2
(45) Date of Patent: May 19, 2020

(54) DEVICE FOR FORMING A PERIPHERAL EDGE OF A CUP BLANK MADE OF PAPER MATERIAL

(71) Applicants: Uwe Messerschmid, Albershausen (DE); Peter Nille, Goeppingen (DE)

(72) Inventors: Uwe Messerschmid, Albershausen (DE); Peter Nille, Goeppingen (DE)

(73) Assignee: MICHAEL HOERAUF MASCHINENFABRIK GMBH UND CO. KG, Donzdorf (DE)

( * ) Notice: Subject to any disclaimer, the term of this patent is extended or adjusted under 35 U.S.C. 154(b) by 893 days.

(21) Appl. No.: 14/509,557

(22) Filed: Oct. 8, 2014

(65) Prior Publication Data

US 2015/0105230 A1 Apr. 16, 2015

(30) Foreign Application Priority Data

Oct. 11, 2013 (DE) ..... 10 2013 220 542

(51) Int. Cl.

| | |
|---|---|
| ***B31B 50/59*** | (2017.01) |
| ***B31B 50/00*** | (2017.01) |
| *B31B 105/00* | (2017.01) |
| *B31B 110/20* | (2017.01) |
| *B31B 110/10* | (2017.01) |

(52) U.S. Cl.

CPC ..... *B31B 50/00* (2017.08); *B31B 50/594* (2018.05); *B31B 2105/00* (2017.08); *B31B 2110/10* (2017.08); *B31B 2110/20* (2017.08)

(58) Field of Classification Search

CPC ..... B65D 1/265; B65D 2543/00092; B65D 2543/00268; B65D 1/26; B65D 2543/00759

USPC .... 493/51, 52, 64, 65, 72, 73, 106, 107, 79, 493/162, 163, 151–159

See application file for complete search history.

(56) References Cited

U.S. PATENT DOCUMENTS

| | | | | |
|---|---|---|---|---|
| 1,089,425 | A * | 3/1914 | Meyer | A47G 23/0216 220/737 |
| 2,100,240 | A | 11/1937 | Cayo | |
| 2,118,080 | A * | 5/1938 | Goodwin | B31B 70/00 425/354 |
| 3,283,673 | A * | 11/1966 | Gettelman | B31B 50/00 493/153 |
| 5,472,402 | A * | 12/1995 | Aloisi | B31F 1/0038 493/149 |
| 5,954,624 | A | 9/1999 | Sandstrom | |
| 8,393,886 | B2 * | 3/2013 | D'Amato | B31F 1/0038 425/387.1 |
| D736,617 | S * | 8/2015 | Sy | D9/429 |
| D769,070 | S * | 10/2016 | Heimsoth | D7/509 |
| 2004/0096601 | A1 * | 5/2004 | Raymond | B29C 67/0048 428/34.1 |

(Continued)

*Primary Examiner* — Andrew M Tecco
*Assistant Examiner* — Eyamindae C Jallow
(74) *Attorney, Agent, or Firm* — Flynn Thiel, P.C.

(57) ABSTRACT

A device for forming a peripheral edge of a cup blank made of paper material, having at least one forming tool, wherein the forming tool is arranged on a tool carrier which is arranged so as to be rotatable about a rotation axis, wherein the rotation axis coincides with a longitudinal centre axis of the cup blank inserted into the device. The forming tool and the tool carrier are configured and arranged so as to travel along a profile, deviating from a circular shape, of the peripheral edge of the cup blank.

18 Claims, 18 Drawing Sheets

(56) References Cited

U.S. PATENT DOCUMENTS

| | | | | |
|---|---|---|---|---|
| 2007/0170236 | A1* | 7/2007 | Rasanen | B65D 43/022 229/404 |
| 2007/0251948 | A1* | 11/2007 | Baker | B65D 43/0212 220/712 |
| 2008/0029525 | A1* | 2/2008 | Rasanen | B29C 53/34 220/658 |
| 2012/0108407 | A1* | 5/2012 | Trani | B65D 43/0229 493/52 |
| 2012/0132699 | A1* | 5/2012 | Mann | B29C 47/0054 229/400 |

* cited by examiner

DEVICE FOR FORMING A PERIPHERAL EDGE OF A CUP BLANK MADE OF PAPER MATERIAL

CROSS REFERENCE TO RELATED APPLICATION

This application claims priority from German Application No. 10 2013 220 542.2, filed on Oct. 11, 2013, the disclosure of which is hereby incorporated by reference into this application in its entirety.

FIELD AND SUMMARY OF THE INVENTION

The invention relates to a device for forming a peripheral edge of a cup blank made of deformable material, in particular cold-formable material, in particular paper material, having at least one forming tool, wherein the forming tool is arranged on a tool carrier which is arranged so as to be rotatable about a rotation axis, wherein the rotation axis coincides with a longitudinal centre axis of the cup blank inserted into the device.

By way of the invention, a device for forming a peripheral edge of a cup blank made of paper material is intended to be provided, it being possible for an edge to be formed quickly and reliably by way of said device and said device being suitable in particular for shaped cups having a cross section that deviates from a circular shape.

In the device according to the invention, the forming tool can travel along a profile or contour, deviating from a circular shape, of the peripheral edge of the cup blank. This not only makes it possible to very reliably contain deviations from the circular shape in cup blanks, said deviations inevitably occurring in mass production, but it is also possible very easily to form the peripheral edges of cup blanks for what are known as shaped cups. As a result, the device according to the invention is usable in a very flexible manner. Thus, according to the invention, it is not the case that a possibly non-round peripheral edge of a cup blank is initially forced into a circular shape by means of a groove-like die stamp, but rather the forming tool and the tool carrier are configured and arranged such that a profile, deviating from a circular shape, of the peripheral edge of the cup blank can be travelled along. As a result, the device according to the invention makes it possible also to process cup blanks that deviate from a circular shape in cross section, in particular what are known as shaped cups, in a gentle manner with respect to the material, and to form a peripheral edge of such cups.

In a development of the invention, the forming tool has at least one protrusion arranged on the tool carrier, said protrusion projecting in a direction parallel to the rotation axis in the direction of the peripheral edge of the cup blank and having a radial component with respect to the rotation axis, such that when the tool carrier is rotated, the protrusion passes over an annular area in which the peripheral edge of the cup blank is arranged.

By means of such a protrusion, the peripheral edge of the cup blank can be formed reliably and for example also be formed into a brim curl or bottom curl. Since, in the event of a rotation of the tool carrier, the protrusion travels over an annular area in which the peripheral edge of the cup blank is arranged, it is also possible to process what are known as shaped cups, which deviate from a circular shape in cross section. Surprisingly, it has been found that, depending on the precise configuration of the profile, deviating from a circular shape, of the peripheral edge, although the protrusion impacts the peripheral edge to be formed at different angles, reliable forming of the peripheral edge that is gentle with respect to the material is nevertheless possible.

In a development of the invention, the protrusion has, in a plane perpendicular to the rotation axis, a profile which is curved, in particular in the form of an arc of a circle, parabolic or spiral.

Surprisingly, it is been found that a curved profile of the protrusion in a plane perpendicular to the rotation axis results in particularly advantageous forming behaviour. The protrusions can in this case be formed in a spiral manner or advantageously as a segment of a circle. A convex side of the protrusions points in this case advantageously in the direction of rotation.

In a development of the invention, a radius of curvature of the protrusion in the plane perpendicular to the rotation axis is in a range between a first radius and a second radius, wherein the first radius corresponds to the distance of the radially inner end of the protrusion from the rotation axis and the second radius corresponds to the radially outer distance of the protrusion from the rotation axis.

Such dimensioning of the radius of curvature of the protrusion in the plane perpendicular to the rotation axis produces very good results with regard to the forming of a peripheral edge of a cup blank.

In a development of the invention, the protrusion has a triangular cross-sectional shape with its tip pointing towards the peripheral edge of the cup blank.

By means of a cross-sectionally triangular protrusion, reliable forming of the peripheral edge of the cup blank can be achieved. A tip of the cross section, or front edge of the protrusion, is in this case rounded in order to prevent or reduce removal of material.

In a development of the invention, the tool carrier is configured as a rotatable disc, the at least one protrusion being arranged on that side of said tool carrier that faces the peripheral edge of the cup blank.

In a development of the invention, a plurality of successive protrusions are arranged in a circumferential direction around the rotation axis.

As a result of the provision of a plurality of successive protrusions, a time for forming the peripheral edge can be reduced. For example, a peripheral edge can be already formed with a quarter rotation of the tool carrier about the rotation axis. Alternatively, it is also possible for the individual protrusions to have different shapes or to extend to different extents in the direction of the peripheral edge to be formed, in order to achieve multistage forming.

In a development of the invention, the protrusions are spaced apart from one another by an angle in the range between 30 degrees and 90 degrees, in particular 60 degrees.

In a development of the invention, the protrusion extends obliquely relative to a plane arranged perpendicularly to the rotation axis. For example, a wedge angle of only a few degrees is used and a distance of a front side of the protrusion, said front side facing the peripheral edge of the cup blank, from the tool carrier increases in the radial direction from outside to inside. In this way, precisely in the case of shaped cups, reliable forming of a peripheral edge of a cup blank can be achieved. In the case of a varying height of the peripheral edge of the cup blank, it has been found that an obliquely positioned forming tool or an obliquely positioned protrusion provides a better result than a tool extending parallel to the top edge.

In a development of the invention, the forming tool has a protrusion that is displaceable on the tool carrier at least in a radial direction.

By means of such a displaceable protrusion, the profile of a peripheral edge, deviating from a circular shape, of the cup blank can be followed during the rotation of the tool carrier.

In a development of the invention, pretensioning means are provided in order to pretension the displaceable protrusion outwardly in the radial direction.

In this way, it is possible to ensure that the peripheral edge is formed radially towards the outside. This can be significant for example when the peripheral edge has a ridge protruding radially towards the inside as a result of preceding processing operations, for example trimming.

In a development of the invention, the displaceable protrusion is guided in a slotted guide on the tool carrier. In particular, the slotted guide extends in the radial direction.

In a development of the invention, the protrusion is arranged on a lever that is articulated in a pivotable manner on the tool carrier.

A profile, deviating from a circular shape, of a peripheral edge of a cup blank can be followed by means of a protrusion that is articulated in a pivotable manner, too.

In a development of the invention, a pivot axis of the lever extends parallel to the rotation axis.

In a development of the invention, the protrusion is embodied by means of a rotatable roller.

By means of a rotatable roller, forming of a peripheral edge that is particularly gentle with respect to the material can be achieved. In particular, the paper material that is used for paper cups is generally provided on the subsequently inner side with a fluid-tight coating. If the protrusion is configured as a rotatable roller, it is possible to reliably ensure that this coating is not damaged during the forming of the peripheral edge.

In a development of the invention, the roller is arranged in a rotatable manner on the lever. Advantageously, a rotation axis of the roller extends parallel to the rotation axis of the tool carrier, such that the roller can roll on the peripheral edge.

In a development of the invention, the lever is pretensioned in a direction away from the rotation axis by means of pretensioning means. In this way, a pretensioning force that is directed radially towards the outside can be exerted on the protrusion or roller, such that, substantially independently of the configuration of the peripheral edge of the cup blank, it is possible to ensure that the forming thereof takes place radially towards the outside.

BRIEF DESCRIPTION OF THE DRAWINGS

Further features and advantages of the invention can be gathered from the claims and the following description of preferred embodiments of the invention in conjunction with the drawings. Individual features of the different embodiments can in this case be combined with one another as desired, without exceeding the scope of the invention. In the drawings:

DETAILED DESCRIPTION

Figure 1:
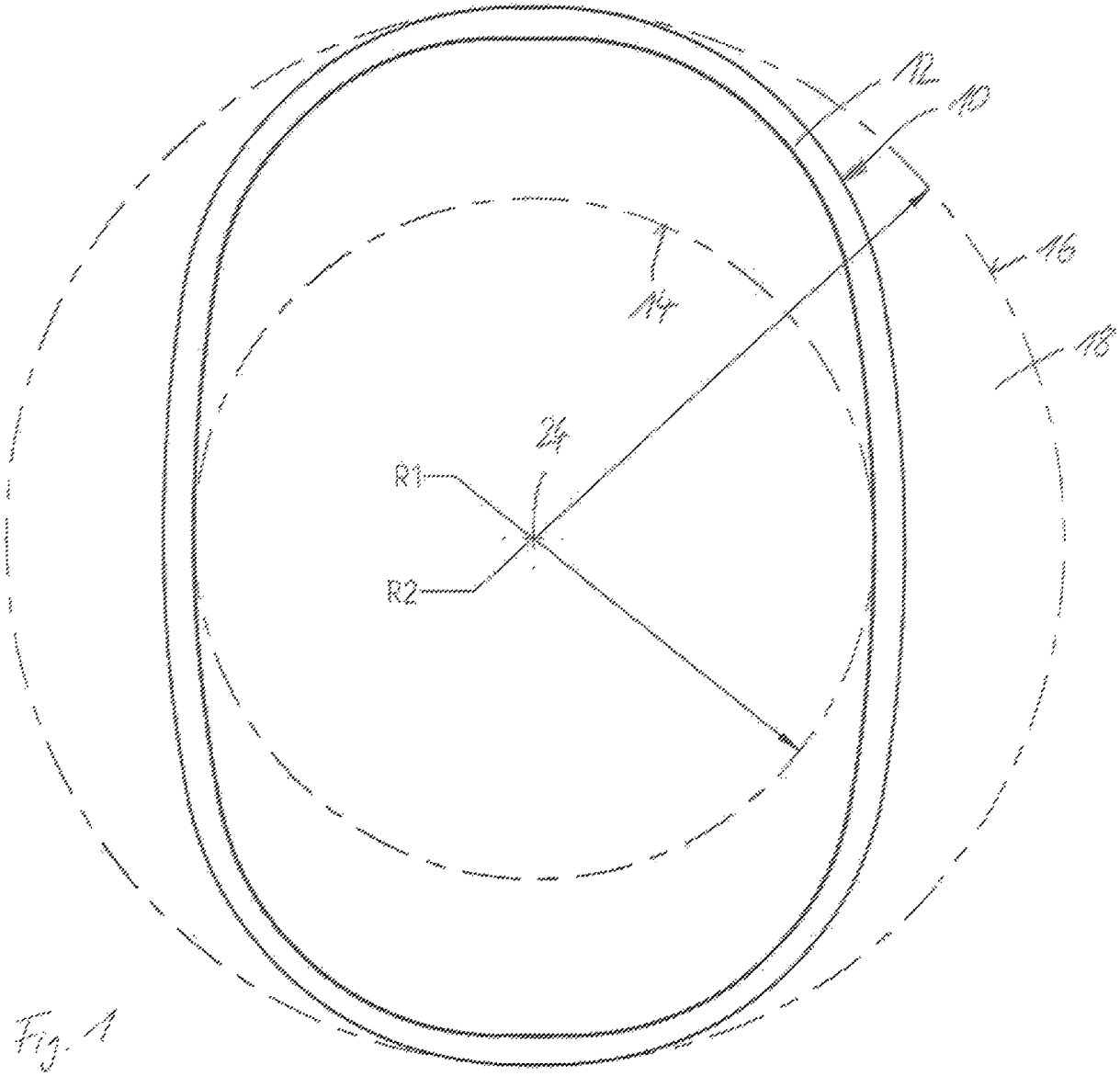
FIG. 1 shows a view from above of a schematic illustration of a peripheral edge of a cup blank for a shaped cup.

The illustration in FIG. 1 shows a schematic plan view of a shaped cup 10 which has a non-circular cross section. The shaped cup 10 has, on its upper, peripheral edge, what is known as a brim curl 12, which is effected by forming, specifically curling in, the upper peripheral edge of a cup blank.

In addition to the brim curl 12, two circles are indicated in FIG. 1, a smaller circle having the radius R1 and a larger circle having the radius R2. The circles 14, 16 delimit an annular area, within which the peripheral edge of a cup blank and consequently also the finished brim curl 12 of the shaped cup 10 are arranged.

Consequently, a forming tool for forming a peripheral edge of a cup blank for a shaped cup of which the cross section deviates from a circular shape either has to pass over the entire area of the circular ring 18 or suitable means have to be provided so that a forming tool follows the non-circular profile of the peripheral edge of the cup blank within the annular area 18.

Figure 2:
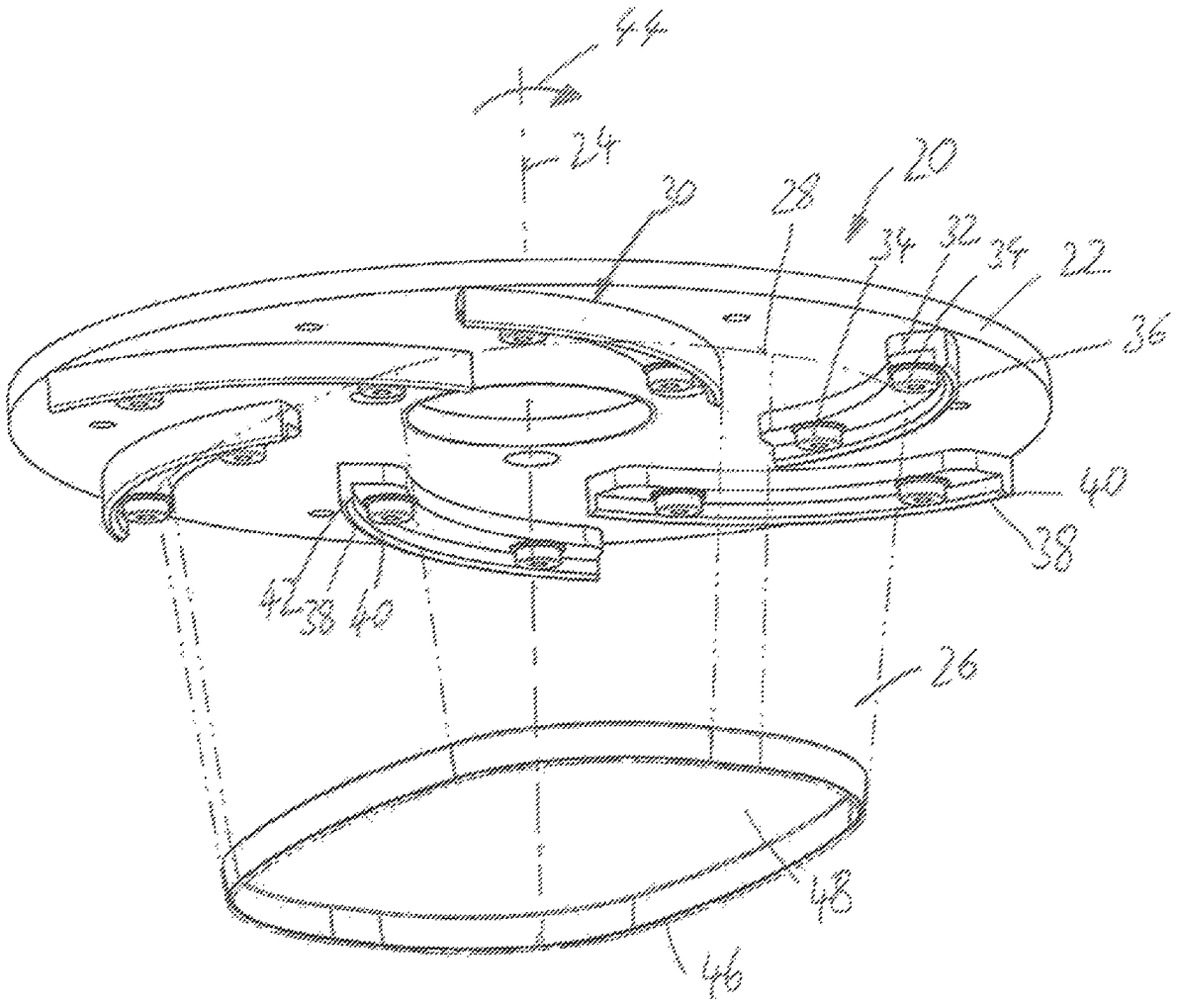
FIG. 2 shows a view, obliquely from below, of a portion of a device according to the invention according to a first embodiment.

The illustration in FIG. 2 shows a first embodiment of a device 20 according to the invention. Only a portion of the device 20 is illustrated, and specifically only a disc-like tool carrier 22 which can rotate about a rotation axis 24 is illustrated. The rotation axis 24 coincides with a longitudinal centre axis of a cup blank 26 which is illustrated partially by way of dashed lines in FIG. 2, is provided for a shaped cup that deviates from a circular shape in cross section, and the peripheral upper edge 28 of which is intended to be formed by way of the device 20.

A total of six protrusions 30 which are spaced apart from one another regularly in the circumferential direction are provided on a side, facing the peripheral edge 28, of the tool carrier 22. The protrusions 30 are each formed in an arcuate manner and have a base limb 32 which extends parallel to the tool carrier 22 and, by means of two screws 34, bears against the underside of the tool carrier 22 and is fastened to the tool carrier 22. Provided at right angles to the base limb 32 is a forming limb 36 which projects freely in the direction of the cup blank 26 and tapers in a triangular manner at its free end, as a result forming a forming edge 38. Two forming slopes 40, 42 run together on the forming edge 38.

The direction of rotation of the tool carrier 22 during the forming of the peripheral edge 28 of the cup blank 26 is in accordance with the arrow 44 in the illustration in FIG. 2. Thus, the protrusions 30 are moved with their convex side towards the front and consequently also impact the peripheral edge 28 by way of their convex side. The protrusions 30 are in this case arranged such that they push the peripheral edge 28 radially towards the outside, that is to say away from the rotation axis 24. An impact angle between the protrusions 30 and a tangent to the peripheral edge is in this case between 0° and 90°, preferably between 20° and 70°. If the impact angle were greater than 90°, the peripheral edge 28 would be pushed radially towards the inside rather than radially towards the outside. Such turning over radially towards the inside may be desired, in order for example to turn over the edge 46, located at the bottom in FIG. 2, of the cup blank 26 radially towards the inside, about a peripheral lip of a bottom 48.

Figure 3:
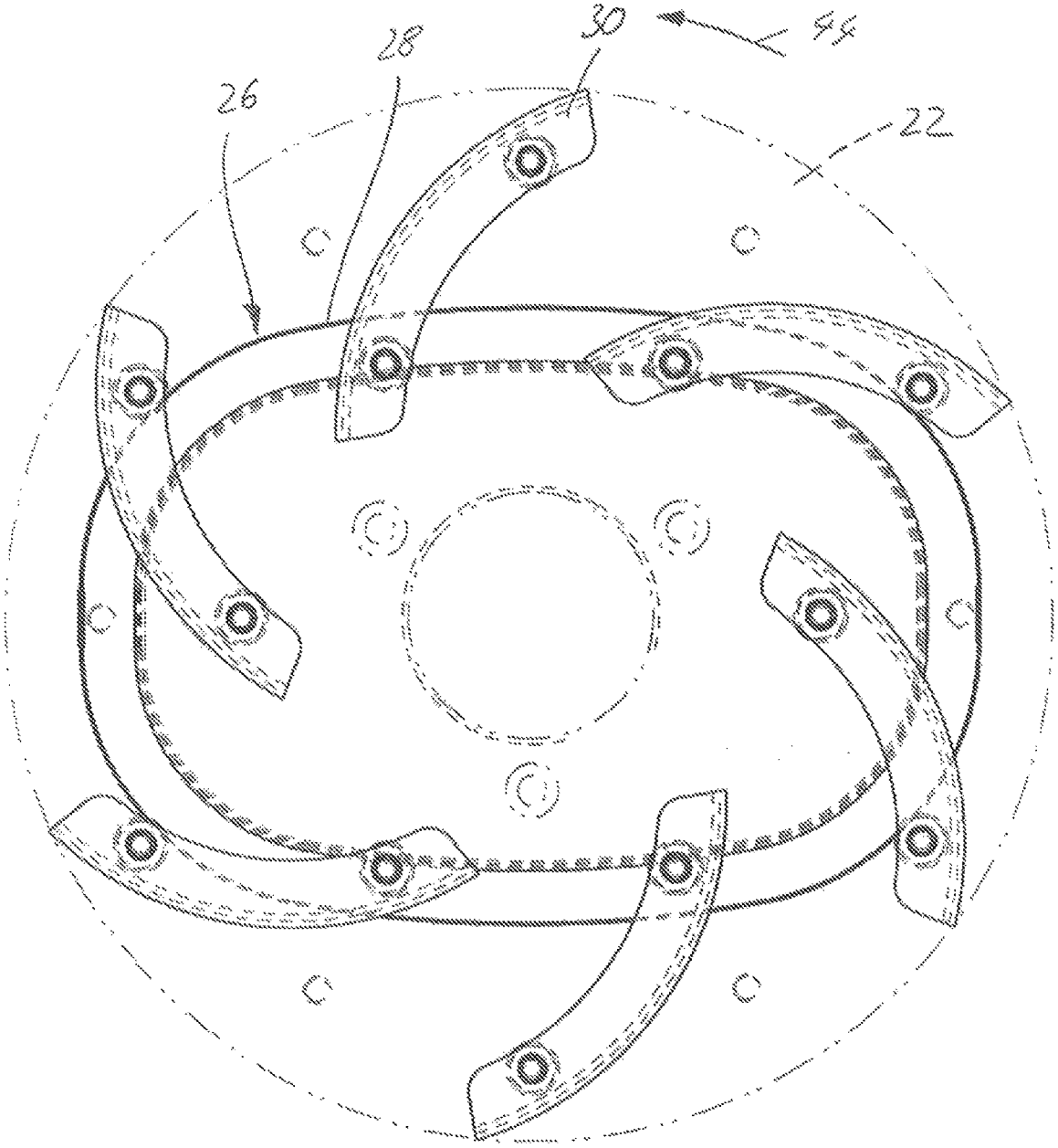
FIG. 3 shows the device from FIG. 2 from above, wherein a tool carrier is indicated merely by way of dashed lines.

The illustration in FIG. 3 shows the device 20 from above, wherein the tool carrier 32 is indicated merely by way of dashed lines, in order to clarify the arrangement of the protrusions 30 on the underside of the tool carrier 22. It can be seen in this view that an angle at which the protrusions 30 impact with respect to a tangent to each particular contact point of the protrusions 30 with the peripheral edge 28 of the cup blank 26 varies over the circumference of the tool carrier 22 but is always in a range between 0° and 90°, and in the illustrated embodiment between 20° and 70°. In the illustrated embodiment, in which the tool carrier 22 rotates as per the arrow 44, the peripheral edge 28 is thus formed radially towards the outside.

In the illustration in FIG. 3, it can furthermore be seen that a radius of curvature of the protrusions 30 is in a range between the first radius R1 and the second radius R2, see FIG. 1, wherein the first radius and the second radius delimit the annular area 18 within which the peripheral edge 28 of the cup blank 26 is located.

Figure 4:
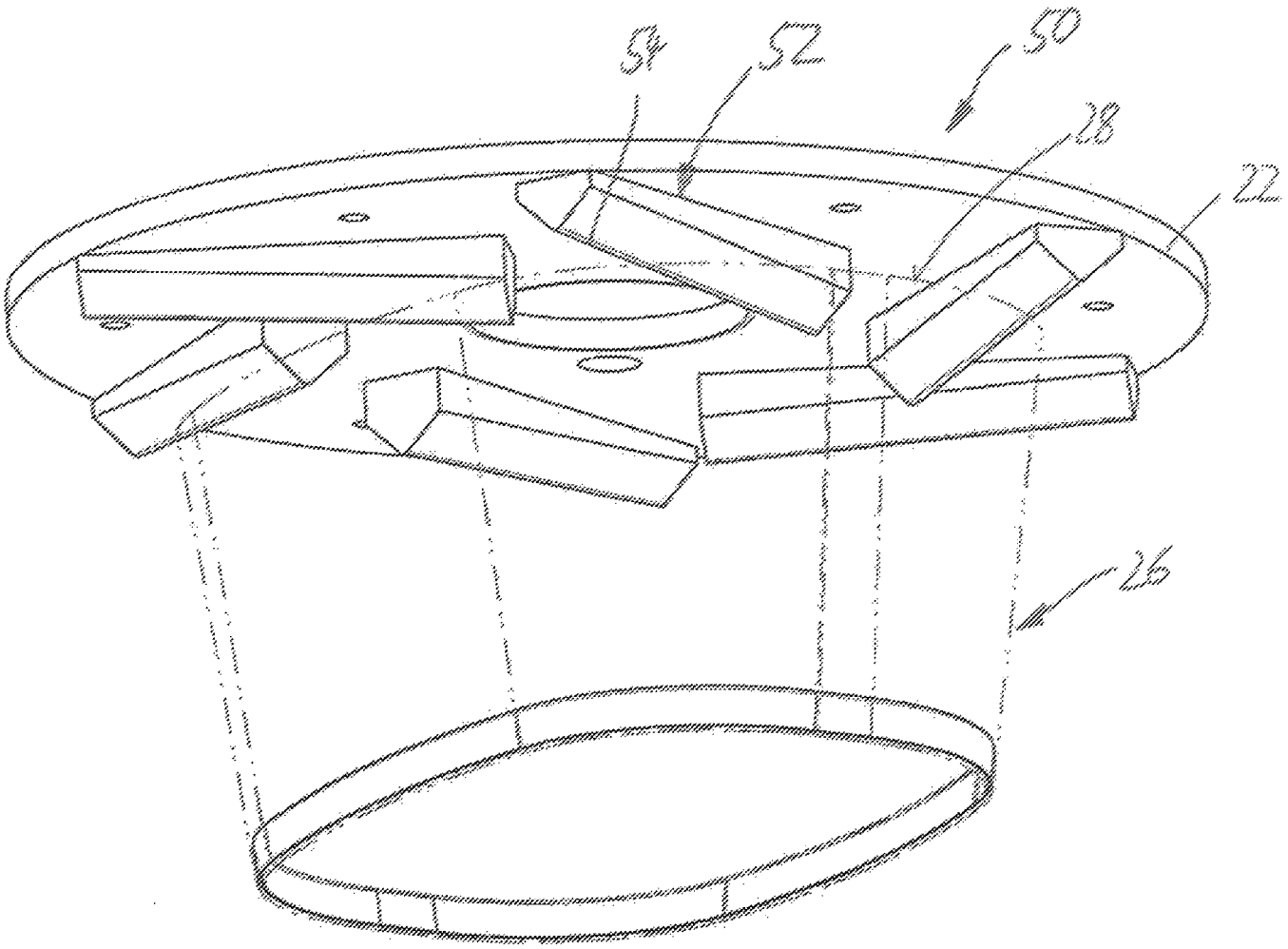
FIG. 4 shows an illustration, obliquely from below, of a portion of a device according to the invention according to a second embodiment.

The illustration in FIG. 4 shows a further device 50 according to the invention, which is provided to form the peripheral edge 28 of the cup blank 26, wherein a cross section of the cup blank 26 and thus also a profile of the peripheral edge 28 deviates from a circular shape.

The device 50 has the tool carrier 22 and a total of six protrusions 52. The protrusions 52 are configured in a prismatic manner and each form a forming edge 54 facing the peripheral edge 28. As seen in cross section, the protrusions 52 have as a result a house-like or rooftop-like shape. However, the protrusions 32 are configured such that a distance of the forming edge 54 from the tool carrier 22 increases in a radially inward direction towards the rotation axis of the tool carrier 22.

Figure 5:
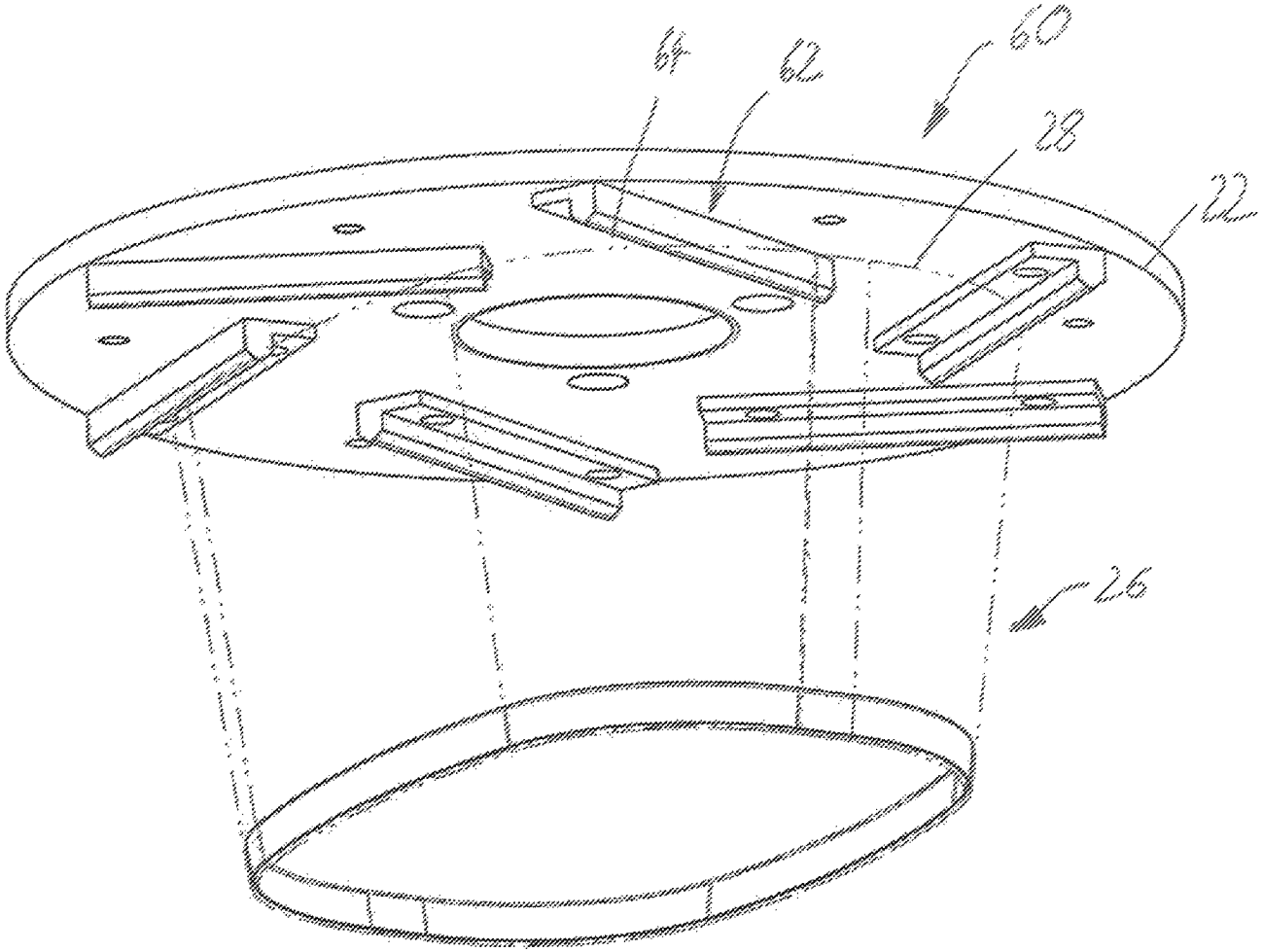
FIG. 5 shows a view, obliquely from below, of a portion of a device according to the invention according to a third embodiment.

The illustration in FIG. 5 shows a further device 60 for forming the peripheral edge 28 of the cup blank 26. The device 60 has a total of six protrusions 62 which, like the protrusions 30 of the device 20 and the protrusions 52 of the device 50, are arranged on the underside of the tool carrier 22 in a manner spaced apart from one another regularly in the circumferential direction.

The protrusions 62 are L-shaped in cross section, wherein a base limb is fastened to the underside of the tool carrier 22 and a forming limb forms a forming edge 64 at its free end. However, in contrast to the protrusions 30 in FIG. 2, the protrusions 62 are not configured in a curved manner but in a rectilinear manner.

Figure 6:
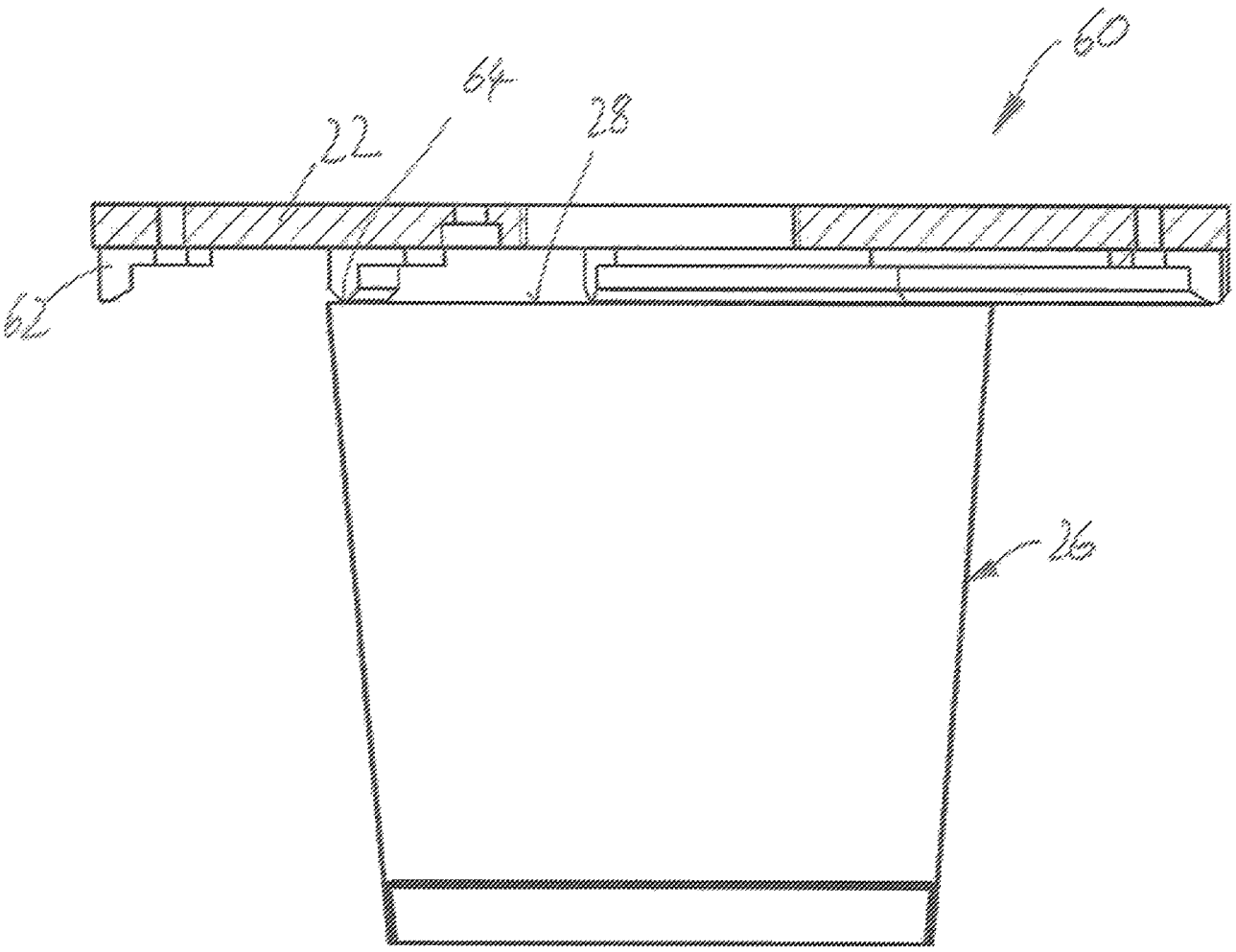
FIG. 6 shows a partially sectional side view of the device from FIG. 5.

The illustration in FIG. 6 shows a sectional side view of the device 60 from FIG. 5. The peripheral edge 28 of the cup blank 26 is formed by means of the forming edge 64 in a direction radially towards the outside.

Figure 7:
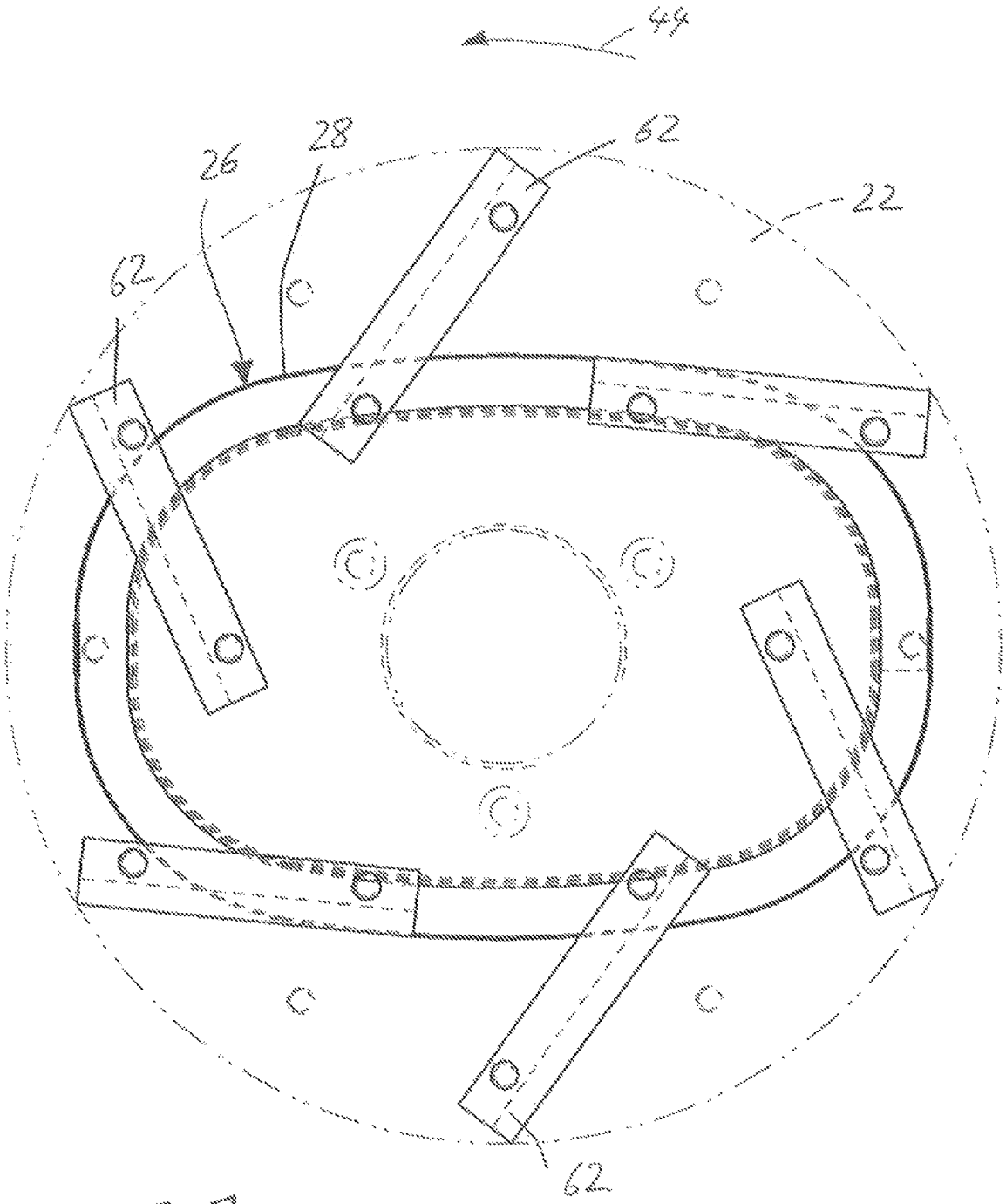
FIG. 7 shows a view from above of the device from FIG. 5, wherein a tool carrier is illustrated by way of dashed lines.

The illustration in FIG. 7 shows a top view of the device from FIG. 5, wherein the tool carrier 22 is illustrated by means of dot-dashed lines. It can be seen that the impact angle of the protrusions 22 with the peripheral edge 28 of the cup blank 26 is between 0° and 90°. A protrusion 62 illustrated at the top left in FIG. 7 and the protrusion 62 illustrated at the bottom right in FIG. 7 are arranged approximately parallel to a tangent to the peripheral edge 28 at each particular contact point. The tool carrier 22 is rotated in the direction of the arrow 44 such that the peripheral edge 28 is formed radially towards the outside.

Figure 8:
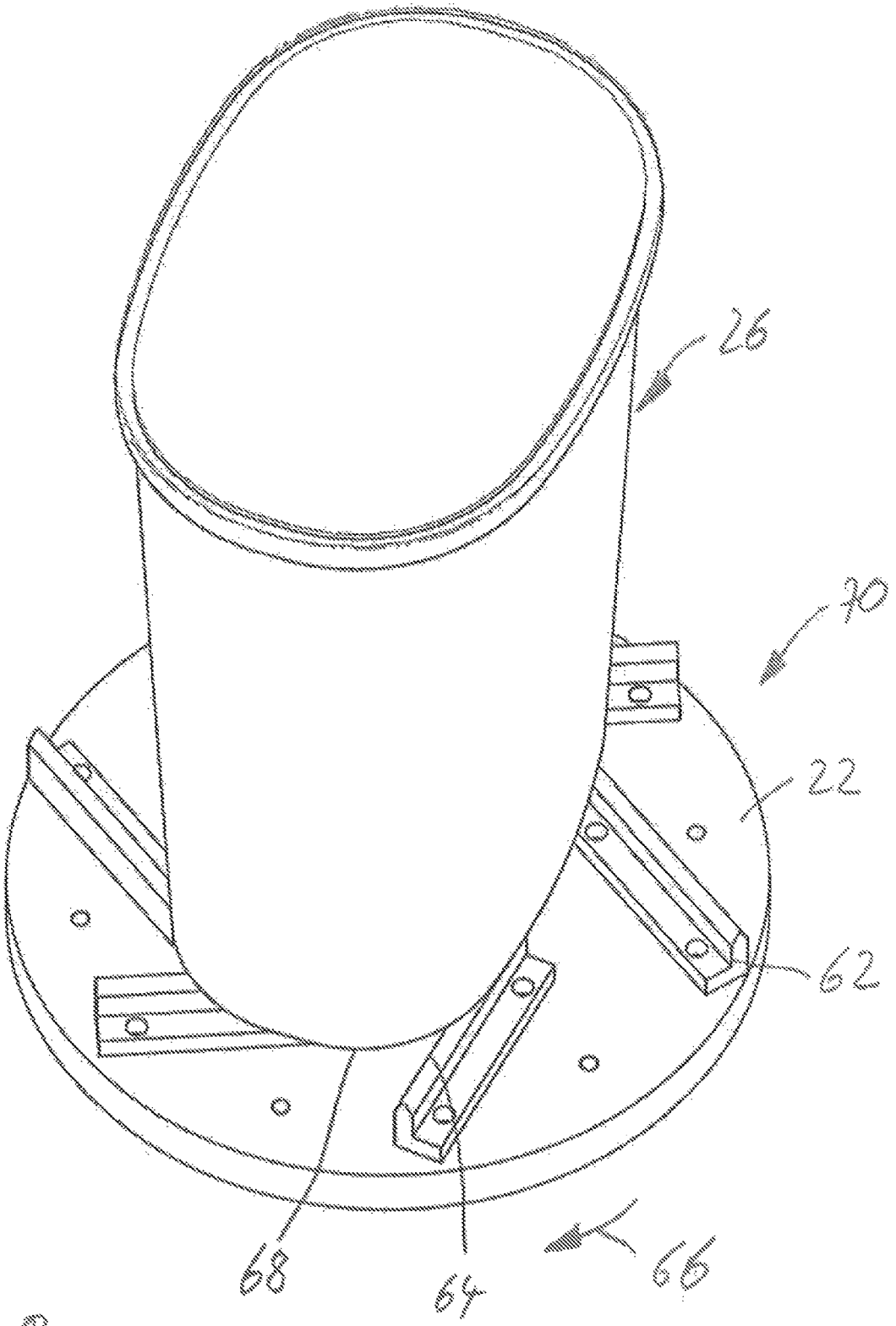
FIG. 8 shows a device, similar to the device in FIG. 5, which is used for forming a lower peripheral edge of a cup blank.

The illustration in FIG. 8 shows a device 70 very similar to the device 60. The device 70 is of identical construction to the device 60 and has the tool carrier 22 and the total of six protrusions 62. However, a direction of rotation of the tool carrier 22 is in this case in accordance with the arrow 66. An impact angle of the forming edge of the respective protrusions 62 with a lower peripheral edge 68 of the cup blank 26 is greater than 90° as a result, and the peripheral edge 68 is formed radially towards the inside, for example turned over a peripheral lip of a cup bottom that is not discernible in FIG. 8.

Figure 9:
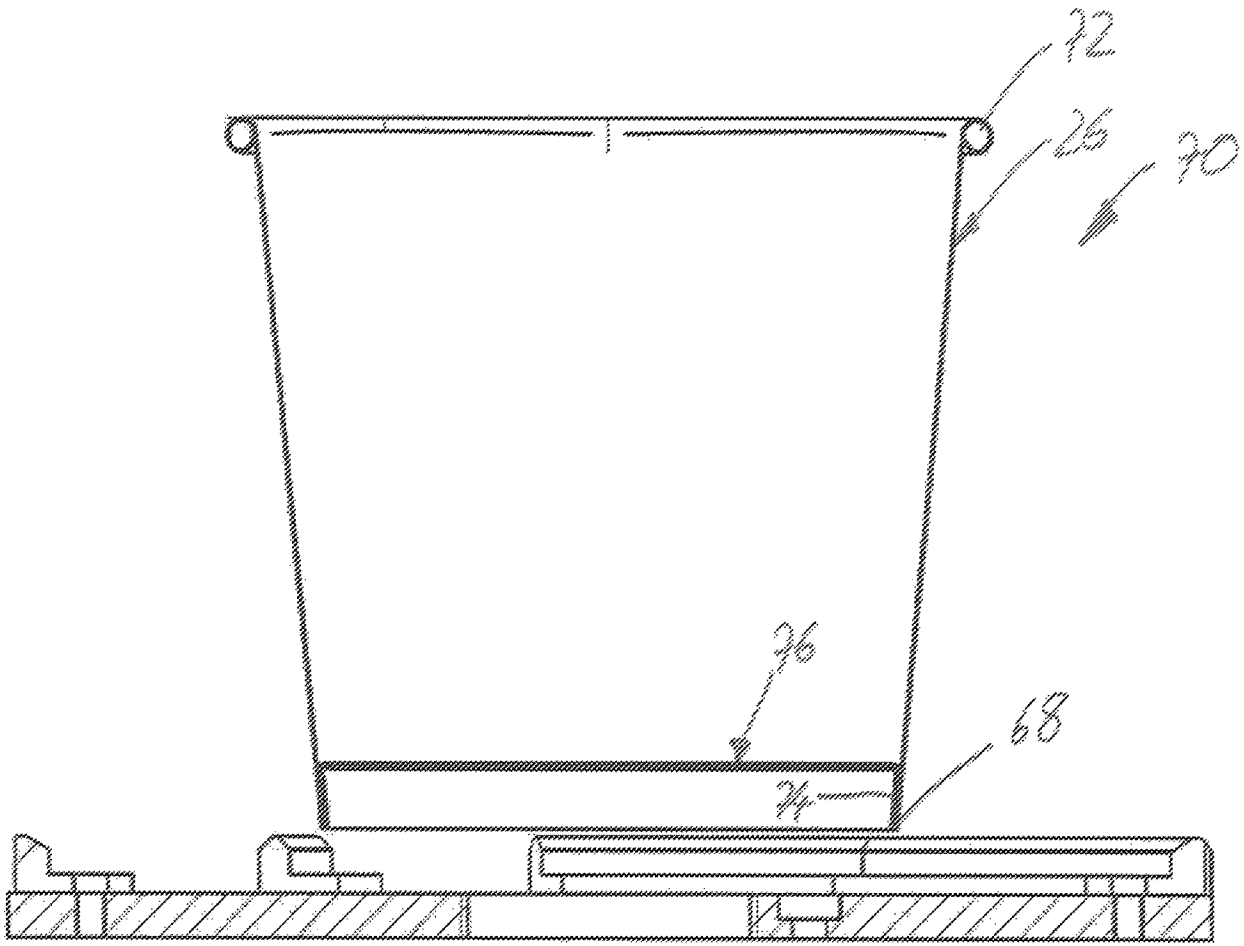
FIG. 9 shows a partially sectional side view of the device from FIG. 8.

The illustration in FIG. 9 shows a sectional side view of the device 70 from FIG. 8. The cup blank 26 is illustrated with a finished brim curl 72 and, by means of the device 70, the lower peripheral edge 68 is turned over the lip 74 of a bottom 76 of the cup blank 26.

Figure 10:
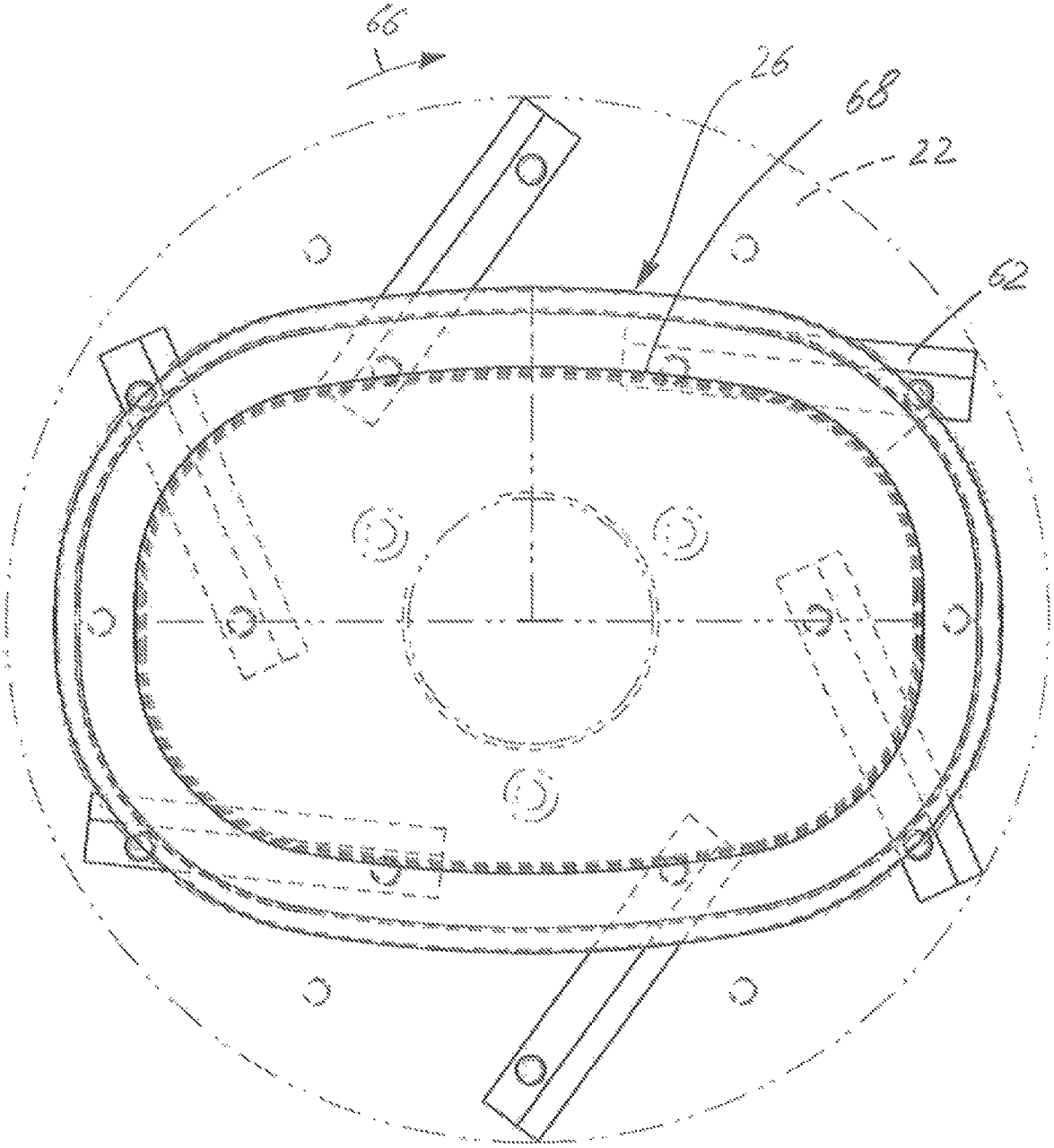
FIG. 10 shows a plan view of the device from FIG. 8, wherein a tool carrier is illustrated by way of dashed lines.

The illustration in FIG. 10 shows the device 70 from FIGS. 8 and 9 from below, wherein the tool carrier 22 is illustrated by way of dashed lines in order to make it possible to discern the position of the protrusions 62. By means of the protrusions 62, the lower peripheral edge 68 of the cup blank 26 is formed radially towards the inside.

Figure 11:
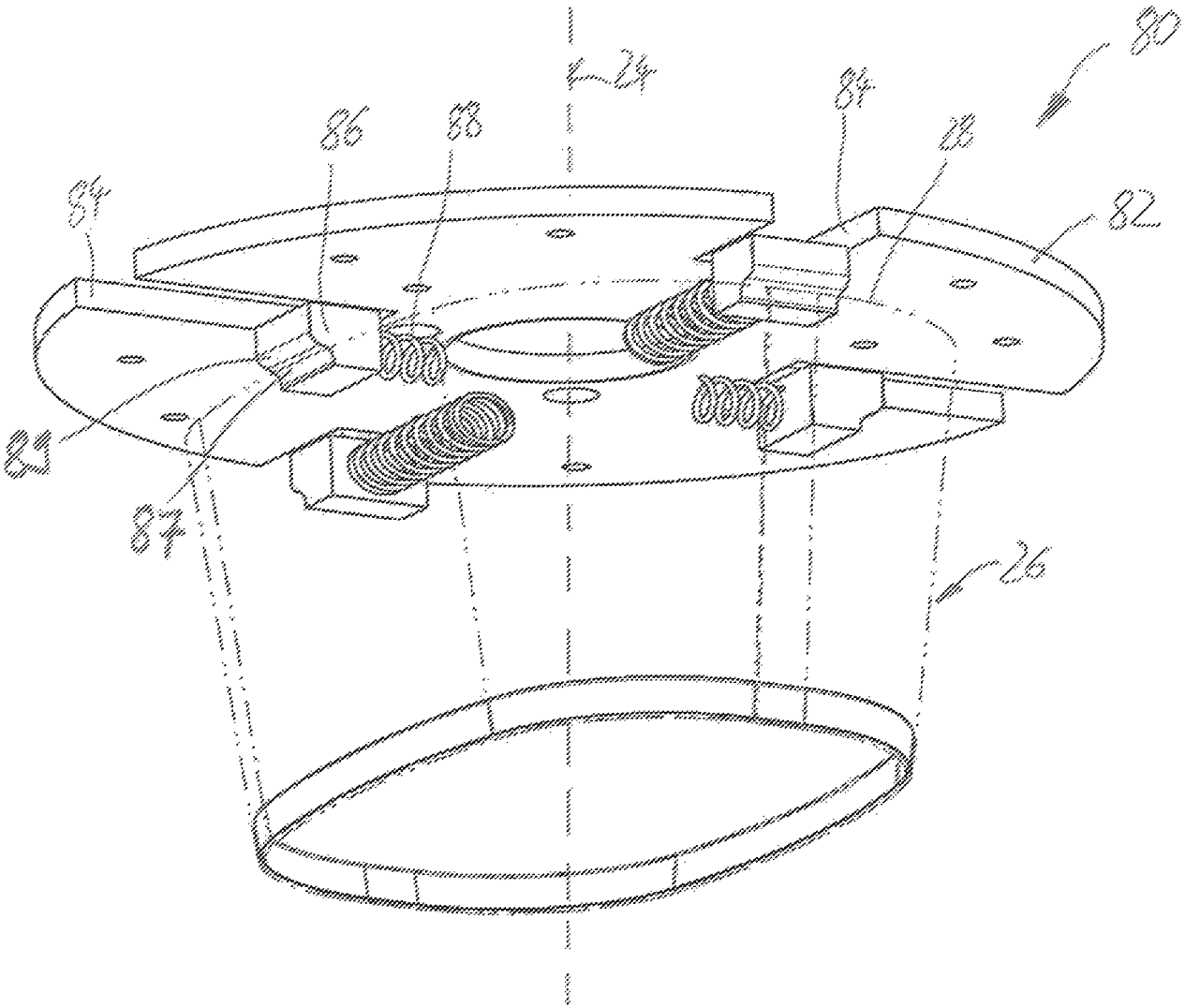
FIG. 11 shows a device according to the invention according to a further embodiment of the invention obliquely from below.

The illustration in FIG. 11 shows a device 80 according to a further embodiment of the invention. The device 80 has a disc-like tool carrier 82 which can rotate about the rotation axis 24. As has already been explained, the rotation axis 24 coincides with the longitudinal centre axis of a cup blank 26 inserted into the device 80.

The tool carrier 22 is configured in a disc-like manner and has a total of four slotted guides 84 that are spaced apart from one another regularly in the circumferential direction and extend in the radial direction. Slides that are not illustrated are guided in each of the slotted guides 84, said slides being provided in each case with a protrusion 86 on their sides facing the cup blank 26. As a result, the protrusions 86 can move in the radial direction relative to the tool carrier 82 and are each pretensioned in a direction radially towards the outside by means of compression springs 88 which are indicated only schematically.

As a result, the protrusions 86 can follow the non-circular profile of the upper peripheral edge 28 of the cup blank 26 and as a result form this peripheral edge 28 in a direction radially towards the outside.

To this end, the protrusions 86 have a concave/convex design on their radially external side. Starting from the cup blank 26 in the direction of the tool carrier 82, that is to say from bottom to top in the illustration in FIG. 11, the protrusions 86 are first of all provided with a concave fillet or groove 87 which then merges into a convex strip 89. Both the groove 87 and the strip 89 extend about the rotation axis 24 tangentially to the circumferential direction and the transitions between the groove 87 and the strip 89 are configured in a rounded manner. The protrusions 86 thus press the peripheral edge 28 radially towards the outside and, with simultaneous axial feeding of the tool carrier 82 parallel to the rotation axis 24 and in the direction towards the cup blank 26, the peripheral edge 28 of the cup blank 26 can be formed into a brim curl as a result.

Figure 12:
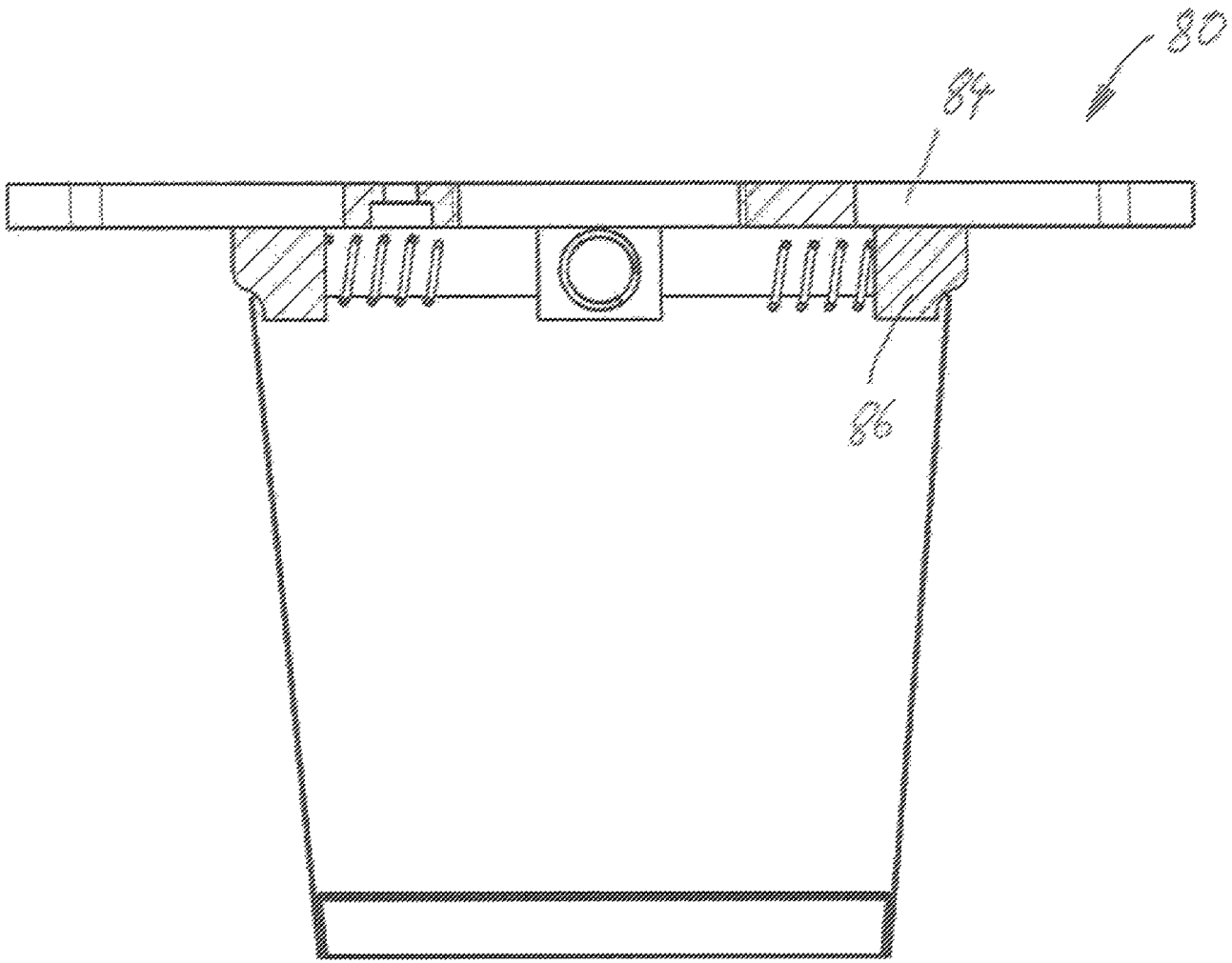
FIG. 12 shows a sectional side view of the device from FIG. 11.

The illustration in FIG. 12 shows the device 80 from FIG. 11 in a sectional side view. The slotted guides 84 and also the concave/convex design of the radially external surface of the protrusions 86 can be seen.

Figure 13:
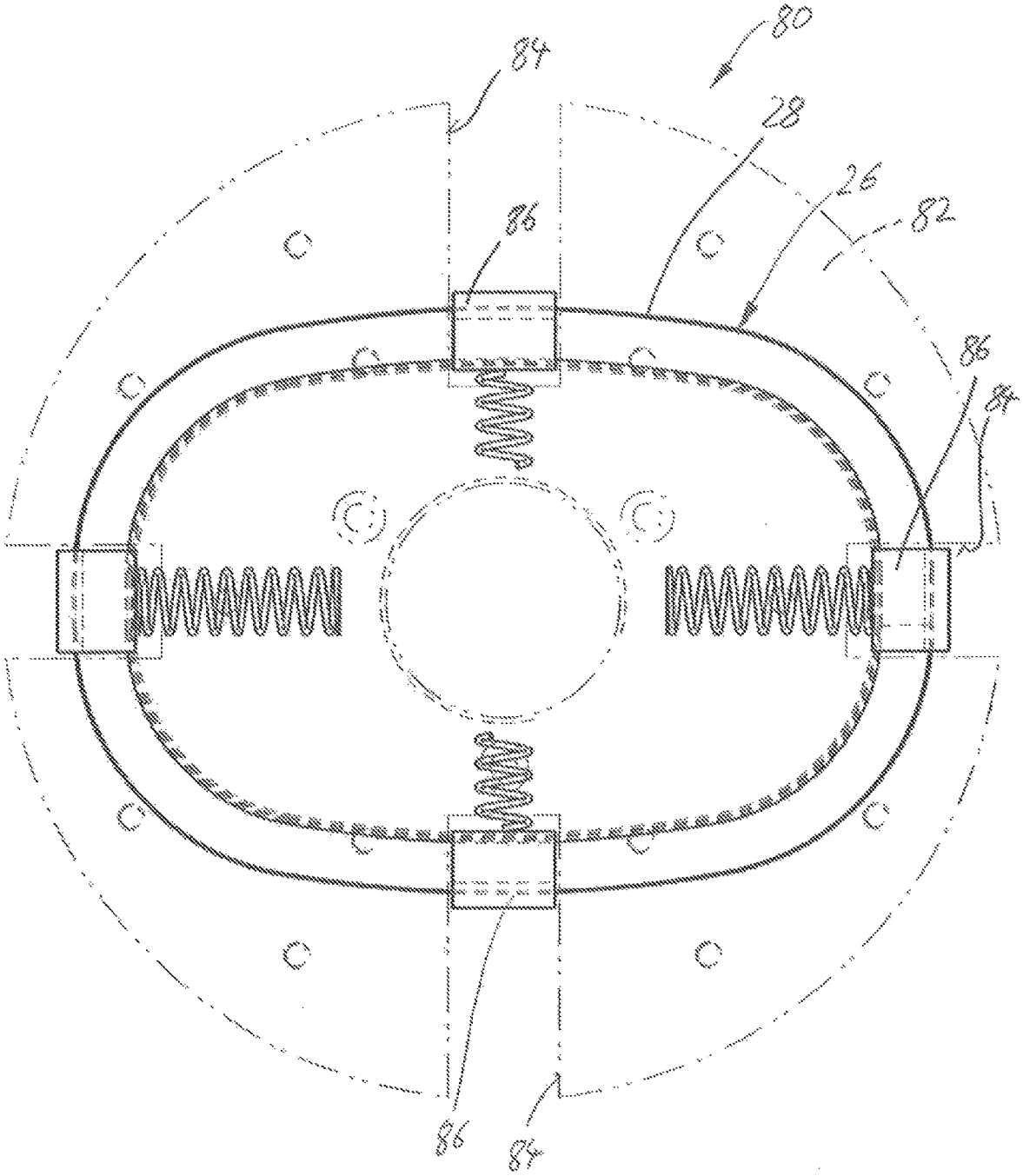
FIG. 13 shows a view of the device from FIG. 11 from above, wherein a tool carrier is illustrated by way of dashed lines.

The illustration in FIG. 13 shows the device from FIG. 11 from above, wherein the tool carrier 82 is illustrated by way of dot-dashed lines in order to clarify the position of the protrusions 86 in each particular slotted guide 84. In the course of a rotation of the tool carrier 82 about the centrally arranged rotation axis 24, the protrusions 86 travel in the radial direction along the slotted guides 84. The direction of rotation of the tool carrier 82 is in this case immaterial in the device 80. The peripheral edge 28 of the cup blank 26 can be formed radially towards the outside both in the case of a rotation of the tool carrier 82 in the clockwise direction and in the case of a rotation of the tool carrier 82 in the anticlockwise direction. In the plan view in FIG. 13, it should be noted that the radially external surfaces of the protrusions 86 having the grooves 87 and the strips 89, see FIG. 11, are illustrated in a rectilinear manner, for the sake of simplicity, but may by all means be configured in the form of an arc of a circle.

Figure 14:
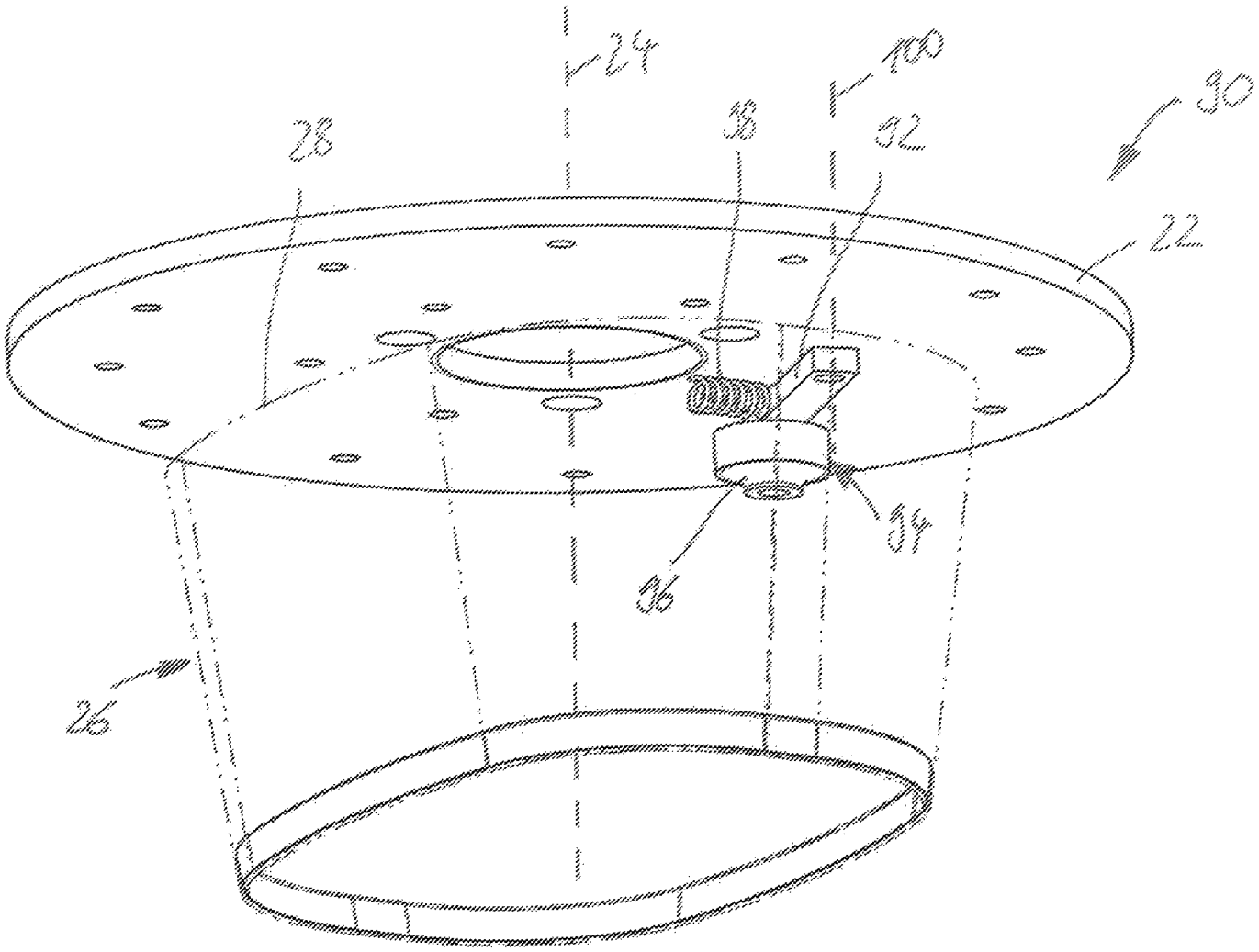
FIG. 14 shows a view, obliquely from below, of a device according to the invention according to a further embodiment.

The illustration in FIG. 14 shows a device 90 according to a further embodiment of the invention. Arranged here on the disc-like tool carrier 22 is a pivotable lever 92, on the free end of which in turn a rotatable roller 94 is arranged. The roller 94 is provided on its side facing the peripheral edge 28 of the cup blank 26 with a concave, peripheral fillet 96. A compression spring, which is indicated merely schematically, pretensions the lever 92 and thus the roller 94 in a direction radially towards the outside.

By way of the pivotable lever 92, which can pivot about a pivot axis 100 that is arranged parallel to the rotation axis 24 of the tool carrier 22, the roller 94 can follow the profile of the peripheral edge 28 of the cup blank 26. As a result of the compression spring 98, the roller 94 is in this case always pretensioned radially towards the outside and as a result forms the peripheral edge 28 radially towards the outside.

Figure 15:
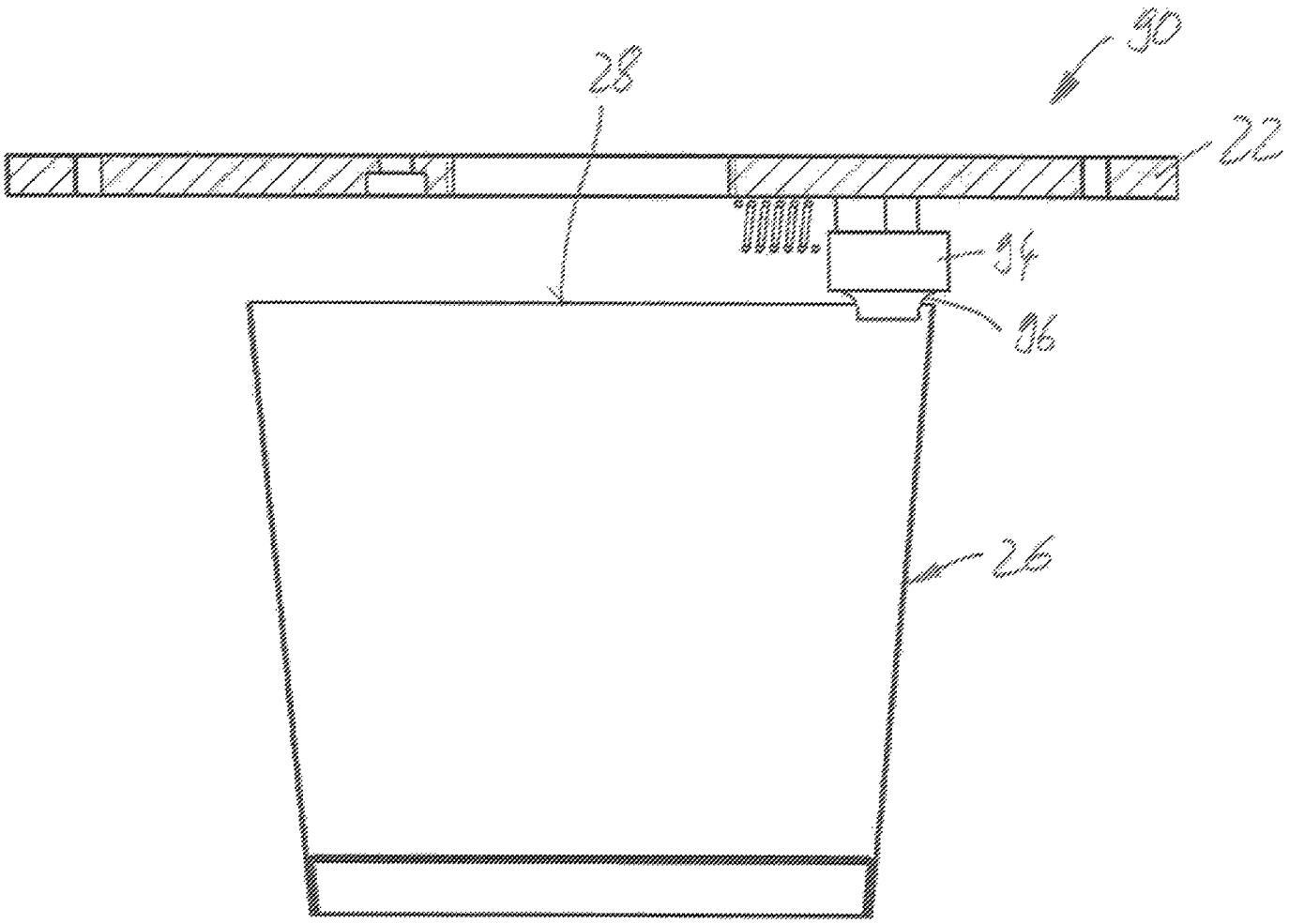
FIG. 15 shows a sectional side view of the device from FIG. 14.

The illustration in FIG. 15 shows a sectional side view of the device 90. The concave fillet 96 on the roller 94 can be seen. The peripheral edge 28 is received in this fillet 96 and likewise formed radially towards the outside by the pretensioning of the roller 94. When the tool carrier 22 is fed axially in the direction towards the cup blank 26, the peripheral edge 28 can be completely turned over as a result and a brim curl can be formed.

Figure 16:
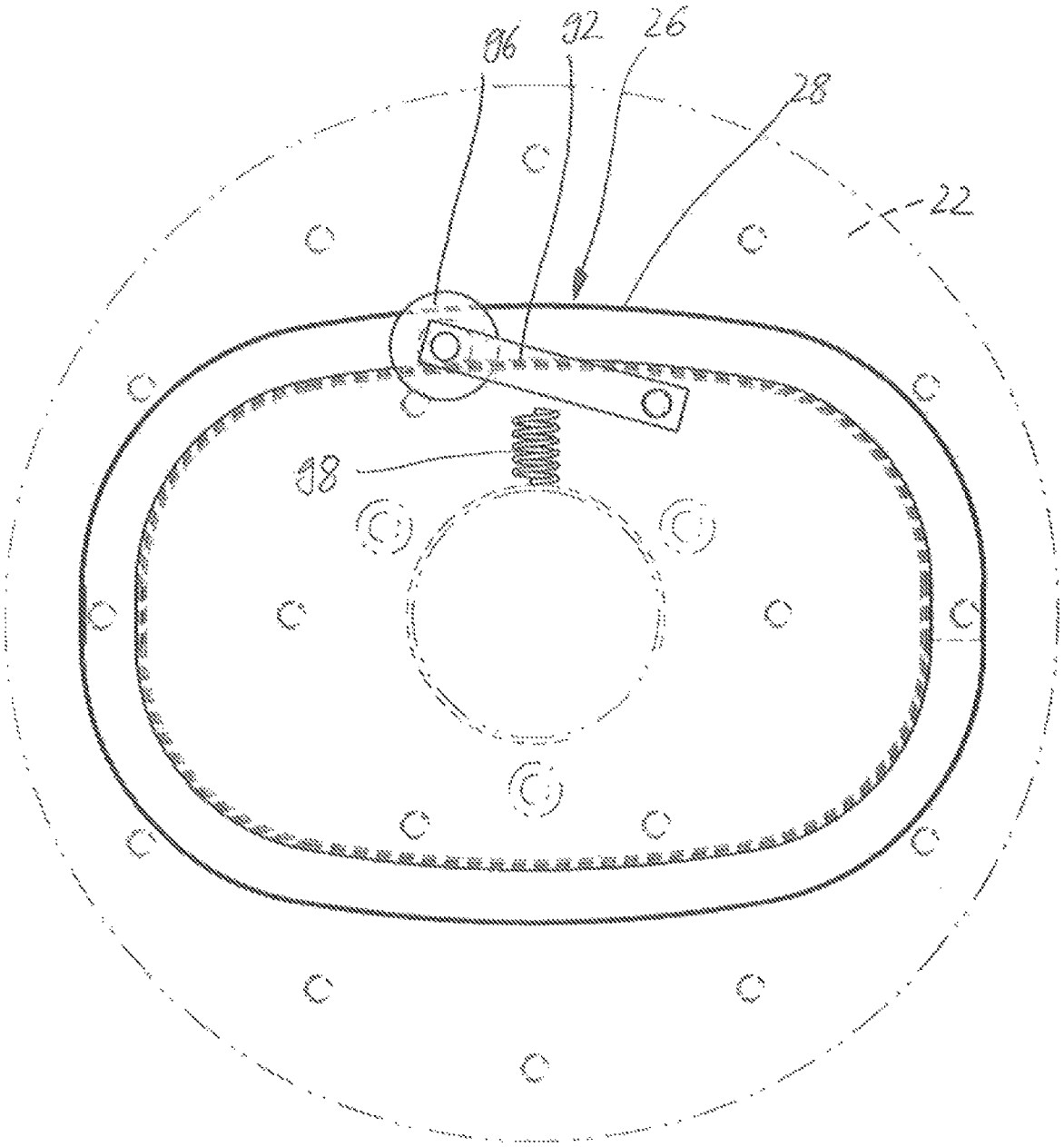
FIG. 16 shows a view from above of the device from FIG. 14, wherein a tool carrier is illustrated by way of dashed lines.

The illustration in FIG. 16 shows the device 90 from FIG. 14 from above, wherein the tool carrier 22 is illustrated by way of dot-dashed lines such that the lever 92, the roller 94 and the compression spring 98 can be seen in their positions relative to the peripheral edge 28 of the cup blank 26. When the tool carrier 22 is rotated, the roller 94 follows the profile, deviating from a circular shape, of the peripheral edge 28 and in the process at the same time forms the latter radially towards the outside.

Only one lever 92 is illustrated, but it is by all means possible for a plurality of levers 92 with rollers 94 to be provided in order to be able to form the entire circumference of the peripheral edge 28 with a rotation of the tool body 22 through less than 360 degrees.

Figure 17:
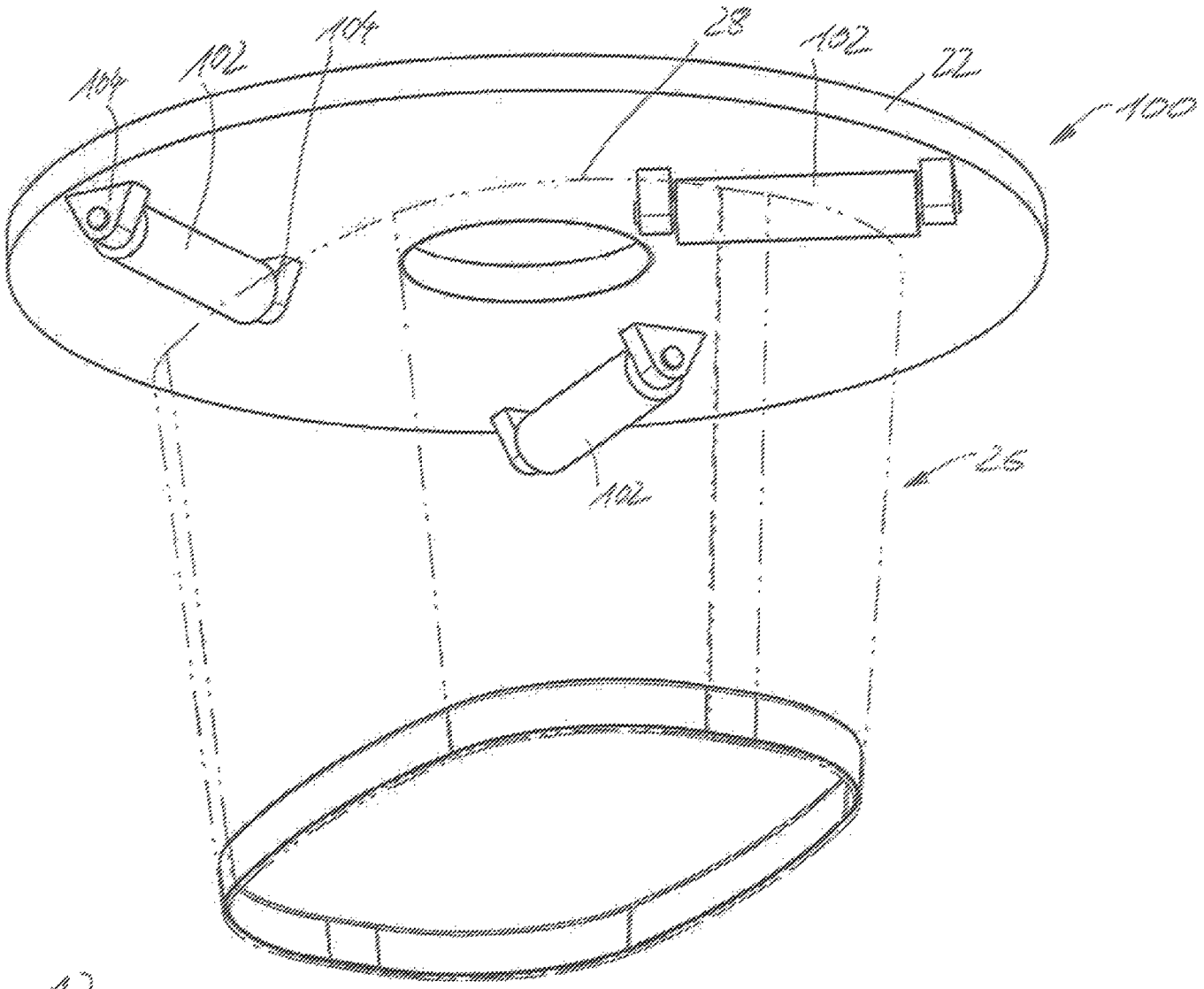
FIG. 17 shows a view, obliquely from below, of a device according to the invention according to a further embodiment.

The illustration in FIG. 17 shows a device 100 according to the invention according to a further embodiment of the invention obliquely from below. As forming tools, the tool carrier 22 carries here a total of three rollers 102 which face the peripheral edge 28 of the cup blank 26. The rollers 102 are mounted rotatably on both sides in protrusions 104 which are in turn connected to the underside of the tool carrier 22. The rollers 102 are in this case much wider or longer than their diameter, so that they can pass over the profile of the peripheral edge of the cup blank 26. The rollers are arranged obliquely with respect to a radial direction of the tool carrier 22. The number of rollers 102 should be selected in this case such that the entire peripheral edge 28 of the cup blank 26 can be formed in the necessary cycle time, optionally even in one movement which is less than 360 degrees of the rotation of the tool carrier 22. The device 100 having the rollers 102 has the advantage that, in spite of a movement component of the rollers 102 perpendicular to the peripheral edge 28, specifically the component of said rollers 102 that is directed towards the outside radially with respect to the tool carrier 22, wear to the peripheral edge 28 can be reduced between the rollers 102 and the peripheral edge. The rollers 102 can be arranged obliquely with respect to a plane extending perpendicularly to the rotation axis, cf. the arrangement of the protrusions 52 in FIG. 4.

Figure 18:
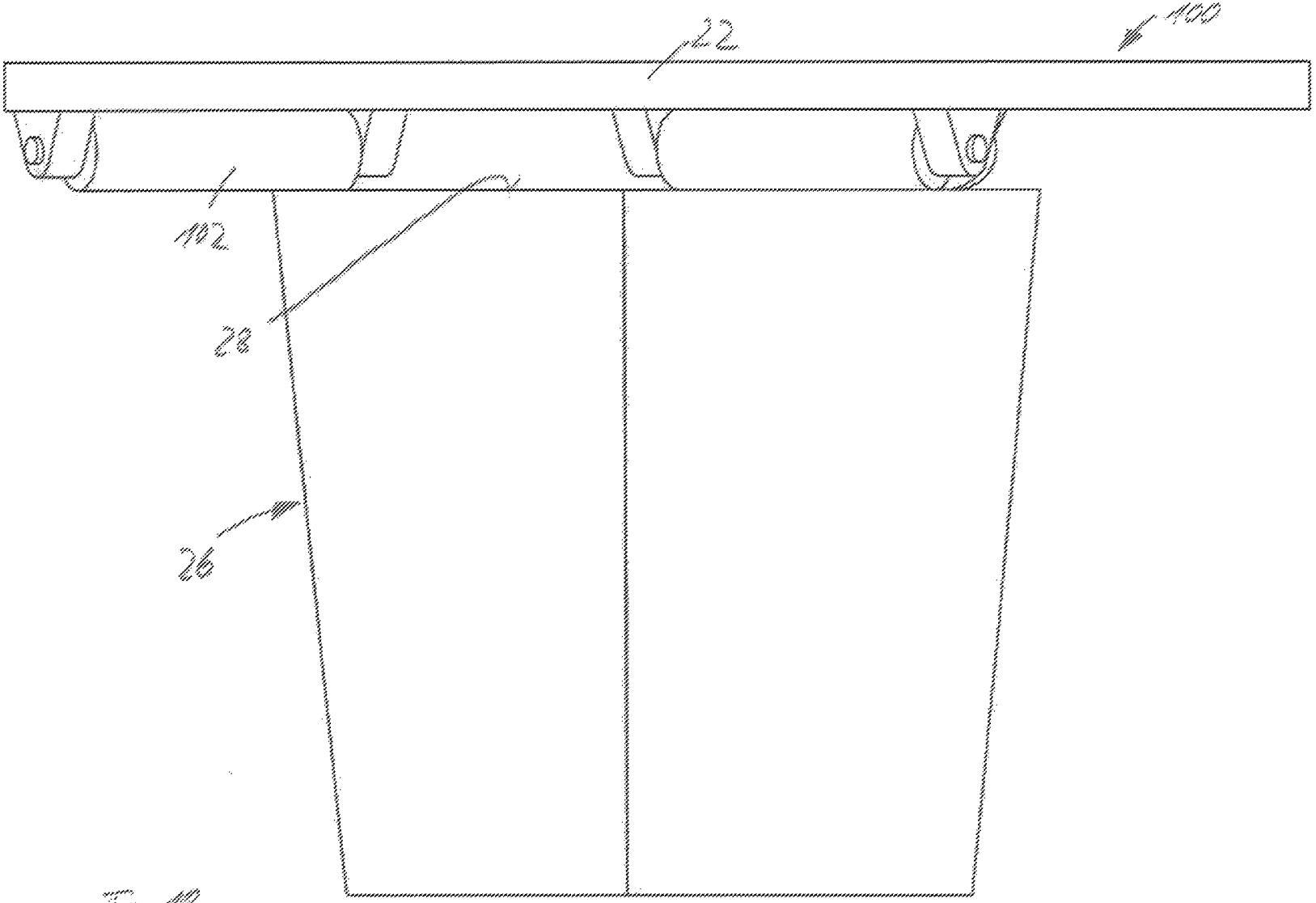
FIG. 18 shows a side view of the device from FIG. 17.

The illustration in FIG. 18 shows the device 100 from the side. It is possible to see the manner in which the rollers 102 roll on the peripheral edge 28 of the cup blank 26 by being moved along this peripheral edge 28 by a rotation of the tool carrier 22 and in the process, not discernible in FIG. 18, form the upper peripheral edge 28.

The invention claimed is:

1. A device for forming a peripheral edge of a cup blank made of deformable material, comprising at least one forming tool, wherein the at least one forming tool is arranged on a tool carrier which is arranged so as to be rotatable about a rotation axis, wherein the rotation axis coincides with a longitudinal centre axis of the cup blank inserted into the device, wherein the at least one forming tool and the tool carrier are configured and arranged so as to travel with respect to a profile, deviating from a circular shape, of the peripheral edge of the cup blank;

wherein the at least one forming tool has at least one protrusion arranged on the tool carrier, said at least one protrusion projecting in a direction parallel to the rotation axis in the direction of the peripheral edge of the cup blank and having a radial component with respect to the rotation axis, such that when the tool carrier is rotated, the at least one protrusion passes over and touches from above an annular area in which the peripheral edge of the cup blank is arranged;

wherein the tool carrier is configured as a rotatable disc, the at least one protrusion being arranged on a side of said tool carrier that faces the peripheral edge of the cup blank; and wherein the rotatable disc is a flat disc having a flat surface and the at least one protrusion projects from the flat surface.

2. The device according to claim 1, wherein the at least one protrusion has, in a plane perpendicular to the rotation axis, a profile which is curved.

3. The device according to claim 2, wherein a radius of curvature of the at least one protrusion in the plane perpendicular to the rotation axis is in a range between a first radius and a second radius, wherein the first radius corresponds to the distance of the radially inner end of the at least one protrusion from the rotation axis and the second radius corresponds to the radially outer distance of the at least one protrusion from the rotation axis.

4. The device according to claim 1, wherein the at least one protrusion has a triangular cross-sectional shape with a tip thereof pointing towards the peripheral edge of the cup blank.

5. The device according to claim 1, wherein the at least one protrusion comprises a plurality of successive protrusions arranged in a circumferential direction around the rotation axis.

6. The device according to claim 5, wherein the protrusions are spaced apart from one another by an angle in the range between 30 degrees and 90 degrees.

7. The device according to claim 1, wherein the at least one protrusion extends obliquely relative to a plane arranged perpendicularly to the rotation axis.

8. The device according to claim 7, wherein a distance of a front side of the at least one protrusion, said front side facing the peripheral edge of the cup blank, from the tool carrier increases in the radial direction from outside to inside.

9. A device for forming a peripheral edge of a cup blank made of deformable material, comprising at least one forming tool, wherein the forming tool is arranged on a tool carrier which is arranged so as to be rotatable about a rotation axis, wherein the rotation axis coincides with a longitudinal centre axis of the cup blank inserted into the device, wherein the forming tool and the tool carrier are configured and arranged so as to travel along a profile, deviating from a circular shape, of the peripheral edge of the cup blank, and wherein the forming tool has a protrusion that is displaceable on the tool carrier, at least in a radial direction.

10. The device according to claim 9, wherein a pretensioner is provided in order to pretension the protrusion outwardly in the radial direction.

11. The device according to claim 10, wherein the protrusion is guided in a slotted guide on the tool carrier.

12. The device according to claim 11, wherein the slotted guide extends in the radial direction.

13. The device according to claim 9, wherein the protrusion is arranged on a lever that is articulated in a pivotable manner on the tool carrier.

14. The device according to claim 13, wherein a pivot axis of the lever extends parallel to the rotation axis.

15. The device according to claim 13, wherein the protrusion is configured as a rotatable roller.

16. The device according to claim 15, wherein the roller is arranged in a rotatable manner on the lever.

17. The device according to claim 13, wherein the lever is pretensioned in a direction away from the rotation axis by a pretensioner.

18. A device for forming a peripheral edge of a cup blank made of deformable material, comprising at least one forming tool, wherein the at least one forming tool is arranged on a tool carrier which is arranged so as to be rotatable about a rotation axis, wherein the rotation axis coincides with a longitudinal centre axis of the cup blank inserted into the device, wherein the at least one forming tool and the tool carrier are configured and arranged so, during rotation about the rotation axis, as to travel with respect to a non-circular profile of the peripheral edge of the cup blank, wherein the at least one forming tool has at least one protrusion arranged on the tool carrier, said at least one protrusion projecting in a direction parallel to the rotation axis in the direction of the peripheral edge of the cup blank and having a radial component with respect to the rotation axis, such that when the tool carrier is rotated, the at least one protrusion passes over and touches from above an annular area in which the peripheral edge of the cup blank is arranged.

* * * * *